US011499278B2

(12) United States Patent
Daniels

(10) Patent No.: US 11,499,278 B2
(45) Date of Patent: Nov. 15, 2022

(54) HIGHWAY MARKER COVER

(71) Applicant: REAGENT CHEMICAL & RESEARCH, INC., Ringoes, NJ (US)

(72) Inventor: William Daniels, Las Vegas, NV (US)

(73) Assignee: REAGENT CHEMICAL & RESEARCH, INC., Ringoes, NJ (US)

( * ) Notice: Subject to any disclaimer, the term of this patent is extended or adjusted under 35 U.S.C. 154(b) by 171 days.

(21) Appl. No.: 16/789,851

(22) Filed: Feb. 13, 2020

(65) Prior Publication Data

US 2020/0263373 A1 Aug. 20, 2020

Related U.S. Application Data

(60) Provisional application No. 62/805,664, filed on Feb. 14, 2019.

(51) Int. Cl.
*E01F 9/553* (2016.01)

(52) U.S. Cl.
CPC ..... *E01F 9/553* (2016.02)

(58) Field of Classification Search
None
See application file for complete search history.

(56) References Cited

U.S. PATENT DOCUMENTS 2,728,323 A * 12/1955 Walton ..... B05B 12/20 428/31
2,831,778 A 4/1958 Allison
3,399,255 A 8/1968 Moehlman
4,145,152 A * 3/1979 Waugh ..... E01F 9/553 118/505
4,717,281 A * 1/1988 Shepherd ..... E01F 9/553 D10/113.1
5,195,841 A * 3/1993 Mullins ..... G01K 11/06 116/217
5,267,809 A * 12/1993 Allan ..... E01F 9/553 404/16
5,310,279 A * 5/1994 Lindner ..... E01F 9/553 404/14
5,435,662 A * 7/1995 Brown ..... E01C 23/06 116/63 C
5,470,170 A * 11/1995 Lindner ..... E01F 9/553 404/13
5,947,475 A 9/1999 Skeuse
6,079,899 A * 6/2000 Green ..... E01F 9/553 116/63 P (Continued)

*Primary Examiner* — Abigail A Risic
(74) *Attorney, Agent, or Firm* — Dilworth & Barrese, LLP

(57) ABSTRACT

A method of resurfacing a length of roadway or other paved surface having markers thereon includes covering the markers with respective marker covers, applying a coating material to the road and the marker covers, then removing the covers. The marker covers mask the markers from the coating material. An inside dimension of the marker covers should approximate the widest outside dimension of the markers. The inside height of the marker cover can be higher than the height the marker extends over the surface. The cover should rest on the surface and not on the marker, for preferred masking and stability. The weight and shape of the covers should permit them to stay in place despite various disrupting forces. After coating, the covers can be removed or crushed in place.

23 Claims, 3 Drawing Sheets

SECTION A-A

(56) References Cited

U.S. PATENT DOCUMENTS

| | | | | |
|---|---|---|---|---|
| 6,267,530 | B1 * | 7/2001 | Attar | E01F 9/553 404/14 |
| 6,428,007 | B2 * | 8/2002 | Skeuse | F41J 1/01 273/363 |
| 6,602,337 | B1 | 8/2003 | Lawry | |
| 6,619,755 | B1 * | 9/2003 | Christensen | E01H 1/0854 299/39.2 |
| 7,393,449 | B1 * | 7/2008 | Kiser | C10C 3/00 106/273.1 |
| 7,625,479 | B1 | 12/2009 | Kiser | |
| 7,690,861 | B1 * | 4/2010 | Johnson | E01F 9/553 404/12 |
| 2001/0007626 | A1 * | 7/2001 | Hedgewick | E01F 9/553 404/9 |
| 2002/0004114 | A1 * | 1/2002 | Leaphart, Jr. | A47G 23/032 428/36.1 |
| 2003/0123930 | A1 * | 7/2003 | Jacobs | E01F 9/512 404/12 |
| 2003/0123931 | A1 * | 7/2003 | Khieu | E01F 9/512 404/12 |
| 2004/0114997 | A1 * | 6/2004 | Stone | E01F 9/541 404/16 |
| 2011/0049153 | A1 * | 3/2011 | Marceca | A47G 19/2211 220/287 |
| 2014/0355910 | A1 * | 12/2014 | Ferris | B65F 1/00 383/105 |
| 2015/0183352 | A1 * | 7/2015 | Bowe | A01K 1/0254 297/184.11 |
| 2017/0356146 | A1 * | 12/2017 | Carey | E01F 9/578 |

* cited by examiner

SECTION A-A

HIGHWAY MARKER COVER

CROSS REFERENCE TO RELATED APPLICATIONS

This application claims the benefit as a Continuation of Provisional Application Ser. No. 62/805,664, filed Feb. 14, 2020, the entire contents of which are incorporated herein by reference.

BACKGROUND OF THE INVENTION

Road and highway safety are major concerns. It has become popular to include reflective and nonreflective pavement markers, including "Raised Pavement Markers" (RPMs) as a safety device on roads. These devices are usually made with plastic, ceramic, thermoplastic, glass or occasionally metal, and come in a variety of shapes and colors. Some raised, level or recessed reflective markers, such as plastic, ceramic, and metal markers, include a lens or sheeting that enhances their visibility with respect to automotive headlights. Some glass road studs gather automotive headlight light with a dome shape and reflect the lights from a reflective layer within. Some other names for specific types of raised pavement markers include convex vibration lines, Botts' dots, delineators, cat's eyes, road studs, or road turtles. Herein, they will be referred to as "raised reflectors, markers, road markers, or highway markers, whether or not they include reflective features and whether or not they are actually raised above the road surface.

Certain raised pavement markers, also known in the art as Botts' dots, are usually round, white or yellow, and are frequently used on highways and interstate roads in lieu of or to supplement painted lines. Botts' dots may also be called turtles or buttons. They are often made out of plastic or ceramic materials. They can be glued to the road surface with epoxy-type adhesives. They are often not suitable for use in areas where snow plowing is conducted as the plows can displace them from their intended position.

Botts' dots are often used, along with reflective raised and level pavement markers, to mark lanes on highways, arterial roads and parking lots. They can provide tactile and/or auditory feedback to drivers when moving across designated travel lanes, and can be analogous to rumble strips. In some locations, highway lanes may be marked either solely by Botts' dots, or with the dots placed over painted lines. Four dots are often used for broken lines on freeways, and broken lines on surface streets may use only three dots.

As used herein, the term "reflector or marker" will include both reflective, semi-reflective and non-reflective Botts' dots. Raised pavement markers are often used in combination with painted stripes and other markings. Often, painted markings are applied after the raised reflectors are installed. Often it becomes necessary to re-paint the markings. However, it is typically undesirable to apply any of the paint on the markers.

The presence of raised road reflectors, particularly large reflectors, has often presented complications when it is desired to resurface or re-seal a road or pavement. Road/pavement re-sealing and/or resurfacing (hereinafter, resurface or coat) is often performed by covering (e.g., spray coating) the road with a thin coating of a tar-based or bituminous-based substance, often incorporating particles such as sand, gravel or other wear resistant material. As used herein, road resurfacing will include surface applications that do and do not include particles. Resurfacing can include the application of a thin layer of asphalt. As used herein, the term "coating" will be used to include both painting, repainting and resurfacing.

It can be costly and time consuming to remove and replace the markers each time a road is coated. Often, to protect the markers prior to coating the road, the markers are masked with tape or covered with sand, which must then be removed after coating is completed, Sometimes, the reflector/marker is not masked and care is taken not to apply any of the coating material on the reflector. However, this is costly and time consuming.

Accordingly, it is desirable to provide a system, method and device for protecting the markers/reflectors when roads are coated that avoids disadvantages of the prior art.

SUMMARY OF THE INVENTION

Generally speaking, in accordance with the invention, a system, protective cover and method of masking markers/reflectors during road coating is provided. The covers should correspond to the footprint of the markers and not extend more that 0-0.5 inches from the foot print of the marker. The covers can be placed over the markers before a road surface is to be coated with paint, tar, asphalt and the like. This cover can be placed over the marker to act as a mask during the coating process. Covers in accordance with the invention should be effectively heavy enough and aerodynamic enough to stay in place in high winds or when vehicles pass by at high speeds so that roads do not need to be closed for prolong periods during coating operations.

It is preferred that the inner dimensions of the covers are only slightly (e.g., less than 10 mm, preferably less than 5 mm) larger that the outer dimension of the marker. Tight fits of essentially the same dimensions are also acceptable. The outer dimension of the cover overlapping the edge of the marker (e.g., the thickness of the cover where it contacts the surface being coated) should be less than e.g., 5 mm, preferably less than 2 or 3 mm beyond the outer edge of the raised marker, to prevent excessive uncoated road. Other dimensions, such as 6, 7, 8, 9 or 10 mm are acceptable for certain applications. If the marker is round, the covers are preferably round. If rectangular, the covers can be rectangular. In general, they should match the footprint of the marker and not extend too far beyond the footprint.

In some applications, the road includes a combination of circular and rectangular markers and/or a combination of reflective and nonreflective markers. In one embodiment of the invention, the circular markers are covered with circular covers and the rectangular covers are covered with rectangular covers. In another embodiment of the invention, all of the markers are covered with the same cover. In still another embodiment of the invention, some of the markers are covered with circular or rectangular covers and other markers are masked in other ways, such as tape, sand, etc.

These protective covers in accordance with the invention can be left over the reflectors/markers until the coating dries and removed quickly by hand or machine and reused. In another embodiment of the invention, the covers are made to be economical enough to be disposed of as a onetime use. In one embodiment of the invention, the covers can be run over and crushed into powder by a vehicle (car or truck) tire or a roller and swept up with a road sweeper. In an embodiment of the invention, after being run over, the crushed debris is left in place. In such situations, it is desirable for the covers to be made from biodegradable materials such as sulfur that will decompose over time and inert filler such as limestone or fly ash.

Road coating projects in accordance with the invention can involve coating 0.5, 1.0, 5.0, 10.0 miles or longer. The number of markers to be covered, then uncovered can exceed 500, 2000, or more. Thus, an assembly of materials for a road coating project can involve enough material to cover 0.5 miles, 1.0 miles or more of road and 500, 2000 or more covers.

Accordingly, it is an object of the invention to provide an improved system, cover and method for protecting road markers.

Still other objects of the invention will in part be obvious and will, in part be apparent from the specification and drawings. The invention accordingly comprises the system, device and method which will be exemplified in the structures and methods hereinafter described, and the scope of the invention will be indicated in the claims.

BRIEF DESCRIPTION OF THE DRAWINGS

The figures are intended to be for the purposes of illustration only, and are not intended to be construed as limiting the scope of the inventions. Similar elements are assigned the same reference numerals. The dimensions can be, but are not necessarily drawn to scale.

DETAILED DESCRIPTION OF THE PREFERRED EMBODIMENTS

Figure 1C:
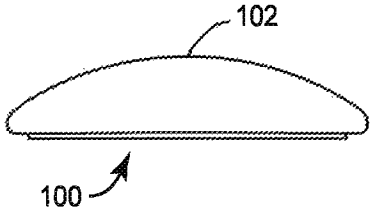
FIG. 1C PRIOR ART
FIG. 1C is a side view of the conventional road marker of FIG. 1A.

In a preferred embodiment of the invention, a length of paved surface extending, e.g., 0.5 miles, 1 mile, 3 miles, 10 miles or longer; or a crosswalk or other intersection, parking or roadway design, such as an exit from a highway is resurfaced or painted (coated). Some crosswalks or exits could have, e.g., 50, 100 or 200 markers on the paved surface.

Certain highway applications include one marker every 120 feet. Therefore, a half mile could have 20 or so markers, a mile could have 40 or more markers, and 5 miles could have 200 or more markers on a paved road in need of resurfacing, coating or painting. Therefore, some applications can involve very large distances, some can involve large numbers of markers, and some can involve both, e.g. more than one or five miles and over 40 or 200 markers. Some pavement coating projects in accordance with the invention involve both long stretches of road plus exits and the like and could involve e.g., over 100 to over 500 markers and over 1 mile of road. Some roads include only a center line. Others involve left and right lines, plus two rows of lane dividers.

Centerline Patterns of road can include supplement double solid-yellow centerline on a two-lane, two-way road with RPMs spaced at 2N-24.4 m (80 ft)-placed between lines. Supplement centerline indicating passing in one direction, on a two-lane, two-way road can include RPMs spaced at 2N-24.4 m (80 ft)-placed between skip lines. Supplement center skip lines indicating passing in both directions, on a two-lane, two-way road can include RPMs spaced at 2N-24.4 m (80 ft)-placed between skip lines. Supplement centerlines indicating a transition from passing in both directions to no passing zone, on a two-lane, two-way road can include RPMs spaced at 2N-24.4 m (80 ft)-placed between skip lines, and with RPMs spaced at N-12.2 m (40 ft)-placed outside of double solid-yellow lines. Supplement double solid-yellow centerline on a multilane, two-way road can include RPMs spaced at N-12.2 m (40 ft)-placed beside lines, specifically 50.8-76.2 mm (2-3 in) away.

Laneline patterns can include supplement broken lanelines with RPMs spaced at 2N-24.4 in (80 ft) placed between skip lines. Edgeline patterns can include supplement solid left edgeline with RPMs spaced at N-12.2 m (40 ft)-placed to the inside of the lane, 50.8-76.2 mm (2-3 in) away from the line.

Specific horizontal curve patterns can include 2N-24.4 in (80 ft)-when the degree of curvature is less than 3 degrees. Others can use N-12.2 m (40 ft)-when the degree of curvature is greater than or equal to 3 degrees but less than 15 degrees. Still others can use N/2-6.1 m (20 ft)-when the degree of curvature is greater than or equal to 15 degrees. For curves greater than 20 degrees, some roadways use two RPMs.

For many road applications, the road will have a series of RPM's—1 reflector and 3 round rpm's. The markers are commonly arranged in a roughly 9 or 10 foot series divided by 30 feet of space. There are commonly approximately 130 of these series in a mile in the center lane. This comprises about 520 markers in a mile for the center. A 4 lane divided highway will often have about 2080 markers per mile.

Road coating projects in accordance with the invention extending 0.5, 1, 5 or 10 miles can involve long roadways and large numbers of markers. Prior to applying the coating material to the road, each of the markers is covered with a marker cover in accordance with the invention. The inside diameter of the marker covers should approximate the outside diameter of the marker. The inside height of the marker cover should be higher than the height the marker extends over the road surface, so that the cover can rest on the road and not on the marker. Marker covers in accordance with the invention are preferably not adhered to the markers with adhesive or the like. The markers are typically substantially in their original condition after the marker covers are removed or otherwise disposed of after coating is completed. The footprint of the cover should approximate the footprint of the marker and not extend excessively from that footprint to prevent overmasking the road and leaving too much of the road around the perimeter of the marker uncoated.

After substantially all the markers are covered with marker covers in accordance with the invention, the road surface is coated. Examples of coatings commonly applied over existing roadways include thin layers of new asphalt, sealers such as bituminous surface treatments designed to preserve and protect asphalt roads and streets, tar, pitch, paint and the like. Often, new middle stripes and lane divider stripes need to be painted, and the markers need to be masked to prevent paint on the markers.

Coatings in accordance with the invention can be applied directly over the marker covers while substantially preventing any of the coating from being applied to the markers. Tar is commonly used to coat pavement. Bituminous surface treatment (BST) or chipseal is also commonly used as a sealing coat to rejuvenate an asphalt concrete pavement. It can include the use of aggregate spread over a sprayed-on asphalt emulsion or cut-back asphalt cement. The aggregate is then embedded into the asphalt by rolling it, typically with a rubber-tired roller. This type of surface is described by a wide variety of regional terms including "chip seal", "tar and chip", "oil and stone", "seal coat", "sprayed seal", "surface dressing", "microsurfacing" or as simply "bitumen."

After the road and marker covers are coated, the marker covers are disposed of, and substantially all the markers can remain substantially free of the coating material. The marker covers can be disposed of by picking each cover up off of the respective marker or by crushing the covers over the marker. If crushed, the debris can be collected with a road sweeper or left to degrade.

The marker covers should be relatively inexpensive, such that a single use option is available. They should be heavy enough to remain in place, but not too heavy, such that their transportation and placement is inconvenient. In one embodiment of the invention, the covers are strong enough to mask the covers until coating is completed, and brittle enough so that they can be crushed into a powder by driving a tire or roller over the markers. The powder can then be either swept away or left to biodegrade.

Figure 1A:
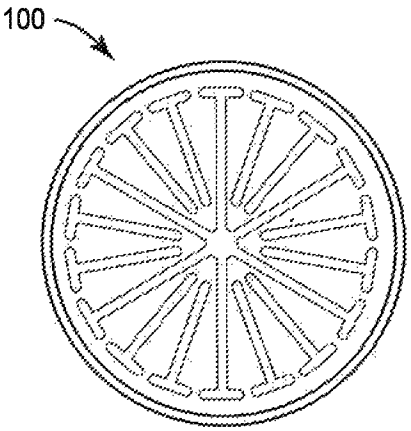
FIG. 1A PRIOR ART
FIG. 1A is a bottom view of a conventional road marker.
Figure 1B:
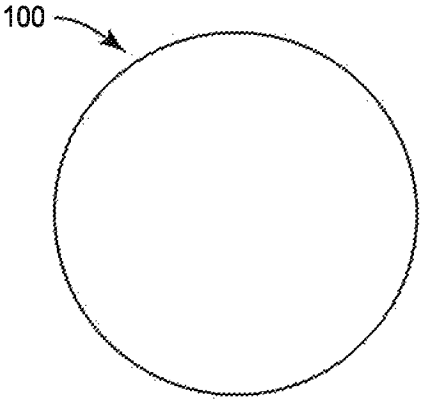
FIG. 1B PRIOR ART
FIG. 1B is a top plan view of the conventional road marker of FIG. 1A.
Figure 2:
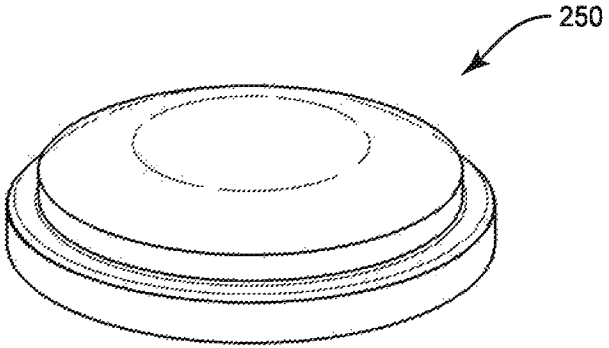
FIG. 2 is a top perspective view of a marker cover in accordance with an embodiment of the invention.
Figure 3:
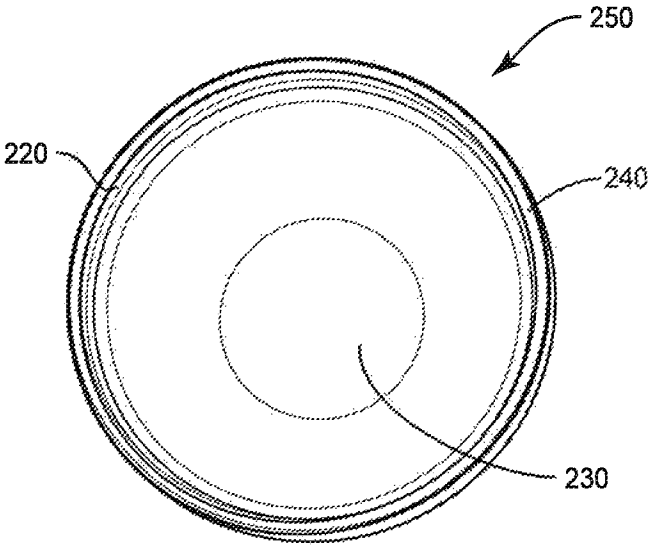
FIG. 3 is a bottom perspective view of the marker cover of FIG. 2.
Figure 4:
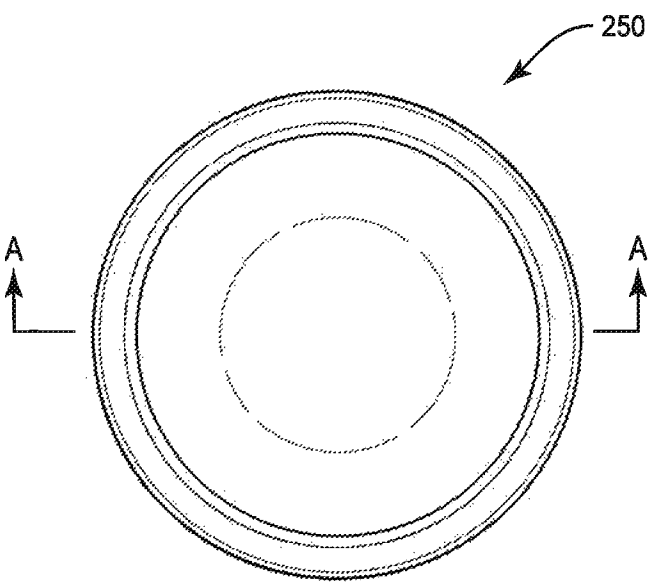
FIG. 4 is a top plan view of the marker cover of FIG. 2.

In one embodiment of the invention, a road marker has the shape of a marker 100 shown generally in FIGS. 1A-C. Marker 100 can have an outer diameter of about 3.5 to 4.5 inches, commonly about 3.8-4.2 inches, more commonly about 3.9 to 4.1 inches and a height of about 0.8 to 0.9 inches. The markers can be recessed into the road surface and do not always extend their full height above the road surface. These dimensions can be varied, as different markers could have different dimensions.

Figure 5:
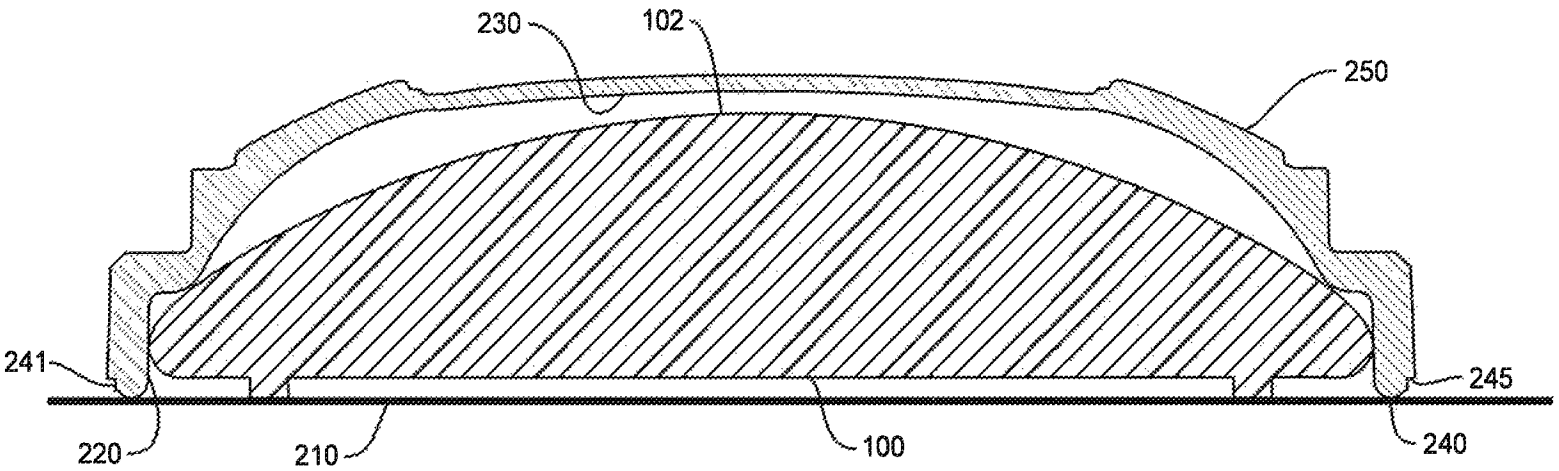
FIG. 5 is a side cross-sectional view of the marker cover of FIG. 2, positioned over the conventional road marker of FIG. 1A.

A cover 250 in accordance with an embodiment of the invention is shown in FIGS. 2-5. Referring to FIG. 5, cover 250 is shown installed over marker 100 on a road surface 210, such as a street, highway or parking lot.

An inner surface 220 of cover 250 can have an inner diameter approximately the outer diameter of marker 100, or slightly larger. For example, the inner diameter of inner surface 220 can be about 3.5 to 4.5 inches, preferably about 3.8-4.2 inches, more preferably about 3.9 to 4.1. This inner diameter can be less than 1%, less than 1-5% or less than 10% larger than the outer diameter of marker 100.

Cover 250 includes an inner ceiling 230. Ceiling 230 should be slightly higher than the top of marker 100, so that cover 250 can rest on road surface 210, and not on a top 102 of marker 100. The gap between top 100 to of marker 100 and ceiling 230 can be greater than 0.01-0.05 inches, alternatively more than about 0.01-0.1 inches above the top of marker 100. Cover 250 can have an outer height from base to outer top, of about 1-2 inches, preferably about 1-1.5 inches and more preferably about 1-1.25 inches.

Cover 250 can also include a lower base 240 resting on surface 210. A lower side wall 241 extends up from lower base 240. In one embodiment of the invention, cover 250 includes a shelf 245 extending horizontally from lower side wall 241. Shelf 245 is useful for aiding in the stacking, handling and removal of cover 250 from marker 100, such as after coating is completed. In one embodiment of the invention, marker 250 is removed with a scoop, dimensioned to contact side wall 241 and catch under shelf 245.

Shelf 245 can be any suitable distance above the bottom of lower base 240, including more than about 0.01 inches from the bottom of lower base 240, or more than about 0.01, 0.2, 0.3, 0.4, 0.5, 0.6, 0.75 or more inches from the bottom of lower base 240. Shelf 245 can also extend any suitable distance out from side wall 241, such as more than 0.01, 0.2, 0.3, 0.4, 0.5, 0.6, or 0.75 inches from side wall 241.

Covers in accordance with the invention should be effectively heavy enough and aerodynamic enough to stay in place in high winds or when vehicles pass by at high speeds or when heavy construction vehicles pass, so that roads do not need to be closed for prolong periods during coating operations. In particular, a dome shape with a short vertical wall rising up from a base is preferred. From the vertical wall, the cover can have an inward extending horizontal shelf to help in stacking and handling, including placing or removing the covers. The covers also preferably have a sloping section, extending to a top section. The top can be flat or can also be sloping to a top dome tip, to promote aerodynamics and prevent air gusts from blowing the cover off the marker.

Covers in accordance with the invention should weigh about 60-200 grams, preferably 80-120 grams, most preferably 95-105 grams when sized to cover a 4 inch diameter round markers and of proportional weights for markers of other dimensions.

One example of a cover can be made with 30-60% sulfur, preferably 40-50% sulfur, more preferably 42-47% sulfur; 35-70% filler, preferably limestone, preferably 45-60%, more preferably 50-55% and 1-10%, preferably 1-5%, more preferably 2-4% lignin sulfonate. The ingredients are preferably melted, then cast into the desired shape.

In one embodiment of the invention, the covers are made to be friable enough that when crushed, the pieces will be small enough so as not to cause a hazard to passing vehicles or pedestrians. In one embodiment of the invention, when crushed by a rubber tire of a four wheel vehicle weighing over 3500 pounds, less than 10% of the particles will be more than about 1 cm in diameter, preferably under 0.25 cm in diameter, more preferably, under 0.1 cm in diameter or a powder. If made from biodegradable materials, such as biodegradable resins or sulfur, the powder or any fragments of the cover can be left to biodegrade.

In another embodiment of the invention, the covers are made of a durable flexible material, that will not fracture if impacted by a vehicle and will not break into fragments. Various rubbers and thermoplastics can be used. In one embodiment of the invention, they are formed to be soft enough so as not to cause substantial damage if caused to impact an object.

Covers in accordance with the invention can be formed with a binder and tiller. In one embodiment of the invention, they are cast into a strong yet brittle state. One binder is pitch. Another is thermoplastic resin. When sulfur is chosen as the binder, the cover preferably includes a sulfur modifier, such as lignin sulfonate. Fillers include limestone powder, fly ash, clays and other inert solid powders. Other materials for improving the properties of the covers, such as degradation promoters and fire retardants can also be included. The covers can be molded or preferably cast to the desired shape.

Covers in accordance with the invention may or may not be substantially pitch free and can have an LD 50 toxicity level greater than 15 g/kg as well as high frangibility. High brittleness can be accomplished in accordance with the invention by forming the covers with high internal stresses. A preferred method of forming the covers is to heat the ingredients to a temperature above which the structure of the material changes, (320 degrees F.) in the case of the sulfur), maintain such temperature for an extended period of time to effect such change (preferably about an hour in the case of the sulfur) and then casting the covers below this temperature, (such as at a temperature of 270 degrees F. for sulfur) to yield a cover in an unstable physical state, which will crush easily.

Binders, and in particular pitch, thermoplastic resin or sulfur are advantageously included in the covers of the invention. The binder should be strong enough to maintain its integrity, yet be sufficiently unstable in one embodiment of the invention to be readily shattered into small fragments under appropriate conditions. Other binders include various resins, waxes, glucosides, starches, sugars, ureas and thermoplastic materials. In one embodiment of the invention, it is preferred that environmentally undesirable binders are avoided. Sulfur is preferably included as about 30%-70%, more preferably 35-45%, even more preferably about 40-42% of the mix.

Fillers are advantageously added to the cover composition. Preferred fillers are inert, solid, not significantly hydroscopic and environmentally acceptable. Calcium carbonate (limestone) especially in a finely ground form and fly ash are preferred fillers. Other fillers include gypsums, sands, clays, glass, metallic sulfates, non-metallic sulfates, ground igneous, sedimentary or metamorphic rock, metal oxides and silicates.

Filler, such as calcium carbonate or fly ash can be included as about 30 to 60% of the target with varying results. Employing approximately 45-55% affords considerable cost effectiveness, while still providing a product with workable consistency and an end product of proper weight and density.

Modifiers are also advantageously included in covers in accordance with the invention to improve molding properties as well as the brittleness of the finished product, where desired. For example, when sulfur is used as a binder, lignin sulfonate is advantageously added, in a preferred range of about 2% to 8%, more preferably about 5% of the weight of sulfur added, or about 1% to 4% and more preferably, about 2% of the weight of the mix.

Degradation promoters can also be desirable. Even if the cover is environmentally benign, fragments of a broken cover can be sharp and may cause internal injuries if swallowed by an animal or thrown by a passing car tire. Broken cover fragments littering a roadway can also be unsightly. Accordingly, it can be desirable to include a degradation promoter, such as a water swellable clay, which will expedite the degradation of used covers and fragments.

Degradation promoters, such as water swellable clays, particularly aluminum silicate (bentonite clay) can also serve as a mixing aid to improve the smoothness of the material during mixing and casting. The degradation promoter (aluminum silicate) is advantageously included as 2 to 4% of the weight of the mix. Insufficient degradation promoter does not tend to produce the desired effect of mix smoothness and environmental breakdown. Excess degradation promoter is costly, can lead to premature degradation of the final product during storage and softer, less brittle covers. Excessive degradation promoter can also affect the structure of the cover, such as leading to cracks formed by the release of internal stresses.

It will thus be seen that the objects set forth above, among those made apparent from the preceding description, are efficiently attained, and, since certain changes may be made in carrying out the above method and in the devices and compositions set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A method of coating a paved surface having at least 500 raised pavement markers thereon, comprising the steps of:

covering the at least 500 markers on the paved surface with at least 500 respective freestanding marker covers, each weighing at least 60 grams and having a footprint corresponding to a footprint of the markers, an inside dimension about as wide as an outside dimension of the markers and an internal height higher than the height of the markers over the paved surface, with a bottom edge of the marker covers contacting the paved surface and supporting the marker covers on the paved surface, spaced above the markers;

applying a coating over the paved surface, including over the at least 500 marker covers and substantially not on the markers; and disposing of the at least 500 marker covers from the at least 500 markers, yielding a coated paved surface with substantially no coating on the markers.

2. The method of claim 1, wherein after the coating is applied to the paved surface and the at least 500 marker covers, substantially each of the marker covers is disposed of by picking up the marker cover from the respective markers.

3. The method of claim 1, wherein after the coating is applied to the paved surface and the at least 500 marker covers, substantially each of the marker covers is disposed of by crushing the marker covers into fragments, in place over the respective markers and less than 10% of the fragments are more than about 0.1 cm in diameter.

4. The method of claim 1, wherein the coating comprises asphalt, bitumen, tar, or pitch.

5. The method of claim 1, wherein the coating comprises paint.

6. The method of claim 1, wherein the markers comprise circular discs with a diameter of about 3.5-4.5 inches, the marker covers have a circular footprint, and the marker covers are not adhered to the markers with adhesive.

7. The method of claim 1, wherein each of the 500 marker covers weigh about 80-120 grams.

8. The method of claim 1, wherein the marker covers comprise about 30-60% sulfur, 1-10% lignin sulfonate, and about 35-70% filler.

9. The method of claim 1, wherein the marker covers have an LD 50 toxicity level greater than 15 g/kg.

10. The method of claim 3, wherein the marker covers are crushed into fragments and less than 10% of the fragments have a diameter greater than 1 cm.

11. The method of claim 1, wherein the marker covers comprise pitch and filler.

12. The method of claim 1, wherein the marker covers are biodegradable.

13. The method of claim 1, wherein the marker covers have an aerodynamic shape and weight effective to stay in place when vehicles pass by at highway speeds.

14. A method of coating a paved road surface of at least a mile in length, having at least 500 markers thereon, comprising the steps of:

covering the at least 500 markers on the at least one mile paved surface with 500 respective marker covers by placing the marker covers in direct contact with the road, above and not contacting the top of the marker covers, each marker cover having a footprint corresponding to a footprint of the markers, an inside dimension about as wide as an outside dimension of the markers, a dome shape with a short vertical wall rising up from a base and a sloping section, extending to a top section, wherein the marker covers are at least 60 grams in weight and effectively heavy enough and aerodynamic enough to stay in place when vehicles pass by at highway speeds, without the use of adhesive to secure the covers to the markers;

applying a coating over the mile long paved surface, including over the at least 500 marker covers and substantially not on the markers; and disposing of the at least 500 marker covers from the at least 500 markers, yielding a coated paved surface with substantially no coating on the markers.

15. The method of claim 14, wherein the covers weigh about 80-120 grams.

16. The method of claim 14, wherein the covers comprise 30-60% sulfur, 35-70% filler, and 1-10% lignin sulfonate.

17. The method of claim 14, wherein the covers comprise pitch and filler.

18. A method of coating a paved surface having markers thereon, comprising the steps of:

covering at least 500 markers on a paved surface with at least 500 respective marker covers by placing the marker covers in direct contact with the paved surface, above and not contacting the top of the marker covers, each marker cover having a footprint corresponding to a footprint of the markers, an inside dimension about as wide as an outside dimension of the markers, and higher than the height of the markers, the marker covers cast from a melt of binder and filler;

applying a coating over the paved surface, including over the at least 500 marker covers and substantially not on the markers; and disposing of the at least 500 marker covers from the at least 500 markers, yielding a coated paved surface with substantially no coating on the markers.

19. The method of claim 18, wherein the marker covers are effectively heavy enough and aerodynamic enough to stay in place when vehicles pass by at highway speeds, with substantially no adhesive thereon.

20. The method of claim 19, wherein the marker covers weigh at least about 60 grams.

21. The method of claim 18, wherein the marker covers and markers have a circular footprint shape.

22. The method of claim 18, wherein each of the marker covers weighs about 80-120 grams.

23. The method of claim 1, wherein the markers are disk shaped Botts' dots.

* * * * *